United States Patent [19]

Soland

[11] 4,152,875

[45] May 8, 1979

[54] GROUND COVERING WITH ADJOINING PLATES

[76] Inventor: Bruno Soland, Wiesengrundstrasse 20, 8942 Oberrieden, Switzerland

[21] Appl. No.: 853,478

[22] Filed: Nov. 21, 1977

[30] Foreign Application Priority Data

Dec. 1, 1976 [CH] Switzerland ..... 15115/76

[51] Int. Cl.[2] ..... E01C 5/16; E01C 9/08; E02B 3/12

[52] U.S. Cl. ..... 52/227; 52/177; 403/19; 404/35

[58] Field of Search ..... 61/37, 38; 404/35, 36, 404/37, 52; 52/177, 585, 227, 573

[56] References Cited

U.S. PATENT DOCUMENTS

| | | | |
|---|---|---|---|
| 544,204 | 8/1895 | Andrews | 52/177 |
| 1,071,091 | 8/1913 | Rogers | 61/38 |
| 2,466,613 | 4/1949 | Richardson | 52/227 |
| 2,833,186 | 5/1958 | Dobell | 52/227 |

*Primary Examiner*—John E. Murtagh
*Attorney, Agent, or Firm*—Werner W. Kleeman

[57] ABSTRACT

A ground covering with adjoining plates clamped to one another by means of tensioning elements extending essentially parallel to the plates and through the plates. Positive locking elements are provided between neighboring plates and effective transversely to the plane at the plates. The positive locking elements comprise spacer holders having domed or arched impact or contact surfaces engaging in sockets at the narrow sides of the plates, and the width of such spacer holders, measured parallel to the plane containing the plates, is smaller than the spacing between the plates.

11 Claims, 11 Drawing Figures

GROUND COVERING WITH ADJOINING PLATES

BACKGROUND OF THE INVENTION

The present invention relates to a new and improved construction of a ground covering containing adjoining plates which are fastened to one another or interlocked by means of tensioning or tightening elements which extend essentially parallel to the plates and through such plates, there also being provided positive locking elements arranged between neighboring plates and effective transversely to the plane of the plates.

In the context of this disclosure the term "ground covering" or equivalent expression, is employed in a broader sense to encompass not only a covering for the ground, but also for other surfaces where such covering might be used.

Such type of ground coverings are particularly used, although not exclusively, in factories, storage areas or warehouses, roller skating rinks and other sport establishments, streets, namely provisional streets or streets designed to have a limited life, runways for aircraft, also runways for sport planes, supply and military aircraft, inclusive of helicopters, and which runways are intended to be provisionally erected or temporarily used. The acceptance of such ground coverings is predicated upon the fact that the plates which can be advantageously prefabricated can be quickly laid, require a comparatively modest amount of preparation and can be immediately used after laying of the ground covering.

Now in Swiss Pat. No. 386,082 there is disclosed one such prior art ground covering. It is composed of square plates. Through each plate there are drawn pairs of tightening or tensioning elements which extend at right angles to one another, and by means of such tensioning elements the plates can be interconnected in their plane into a comparatively rigid structure. Formed at two of the narrow sides of each plate are tongues of trapezoidal shape in cross-section, these tongues engaging into a respective one of two grooves which are formed at both of the remaining narrow sides of the neighboring plates. The groove-and-tongue connection constitutes a positive of form locking element which is effective transversely to the plane of the plates.

However, this state-of-the-art ground covering is associated with different drawbacks. As is known it is unavoidable that individual plates of the composite structure will rupture, whether such be due to overload, because of a local dropping of the ground or owing to the effects of frost or other adverse weather conditions. Yet, a broken or ruptured plate constitutes a non-inconsequential risk for the vehicles or the like which travel upon the ground covering. With this prior art ground covering replacement of an individual broken plate is not possible because of the groove-and-tongue connection, without dismantling an appreciable part of the entire ground covering.

Furthermore, the heretofore known ground covering can only adapt itself to a limited degree to dropping or sinking of the ground and the ground and can only adapt itself to a limited extent for snugly nesting against changing shapes of the ground, without there arising breaking-out of the tongue and/or the groove, which, in turn, can cause similar adverse consequences, such as rupture of a plate.

In addition to the foregoing, there is further to be considered the fact that exactly in its most preferred fields of application the prior art ground or floor covering affords a practically tight covering of the ground upon which it is laid. In other words, apart from at the region of its edges, the heretofore known ground covering does not provide practically any drainage possibility for rain water, so that so-to-speak there unavoidably are produced water pools or puddles, not even considering the disturbances which are caused by the ground water beneath the covering.

SUMMARY OF THE INVENTION

Hence, with the foregoing in mind, it is a primary object of the present invention to provide a new and improved construction of ground covering which is not associated with the aforementioned drawbacks and limitations of the prior art proposals.

Another and more specific object of the present invention aims at the provision of a new and improved construction of ground covering of the previously mentioned type which extensively avoids the aforementioned drawbacks of the state-of-the-art coverings, without relinquishing the advantages thereof, in particular that the load is distributed by the tensioning elements over a number of plates present at the region of the load, so that the specific loading of an individual plate can be maintained within tolerable limits.

Yet a further significant object of the present invention is directed to a ground covering which is relatively simple in construction and design, economical to manufacture, easy to assemble, having good load-carrying capability, enables damaged plates of the ground covering to be replaced with a minimum of effort, and allows rain water or the like to drain off to avoid or minimize the formation of puddles and the like.

Now in order to implement these and still further objects of the invention, which will become more readily apparent as the description proceeds, the positive locking elements of the ground covering comprise spacer holders having domed or arched contact or impact surfaces which engage into sockets provided at the narrow sides of the plates, and wherein the width of such spacer holders, measured parallel to the plane of the plates, is smaller than the spacing between the plates.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
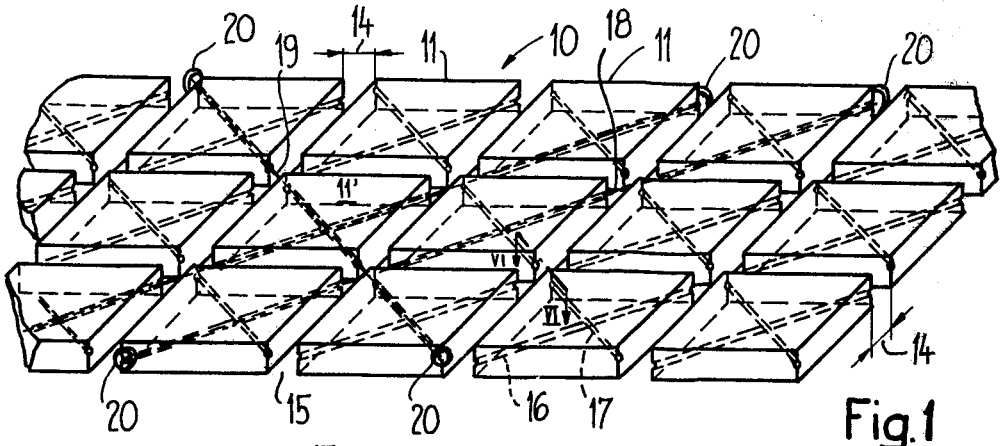
FIG. 1 is a schematic perspective view of a ground covering prepared for the insertion of the spacer holders and at which ground covering there have already been attached a number of the tensioning elements.
Figure 7:
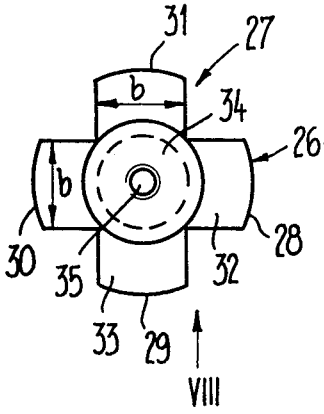
FIG. 7 is a top plan view of a spacer holder used in the ground covering of the invention.
Figure 8:
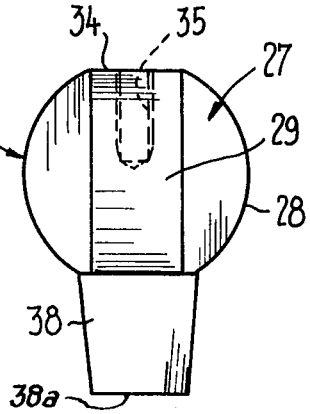
FIG. 8 is a view of the spacer holder at FIG. 7 looking in the direction of the arrow VIII thereof.

Describing now the drawings, initially reference will be made to the ground covering shown in FIGS. 1-3. The illustrated ground covering 10 is essentially composed of joined together plates 11. In the embodiment under discussion the plates 11 are of square configuration, but it is to be expressly understood that other plate shapes can be employed, specifically rectangular or hexagonal plates, provided that their shape renders possible uniform covering of a ground or floor surface. Neighboring plates 11 do not directly abut one another at their narrow sides 12 and 13, rather are held in spaced relationship from one another at a spacing 14 by spacer holders 26 to be described more fully hereinafter with reference to FIGS. 7 and 8. It is also to be understood that such neighboring plates 11, during the mounting or assembly thereof, are placed upon the ground to be covered at such spacing 14 from one another. In FIG. 1 the degree of the spacing 14 has been shown quite exaggerated. While the plates 11 can have a side length of one meter or more, the spacing 14 between neighboring plates 11 only amounts to about 10-20 mm, so that drainage joints or channels 15 remain free between neighboring plates 11, the width of such joints or channels 15 amounting to the spacing 14.

Passages or passageways 16 and 17 extend through each of the plates 11 in a direction parallel to the plane of the plates and at right angles to one another, but such passageways do not intersect one another. These passageways or passages 16 and 17 are arranged in such a manner that at the ground covering 10 always a number of passages 16 are in alignment with one another and equally a number of passages 17 are in alignment with one another. With the exemplary embodiments of FIGS. 2 and 3 there is provided for each plate 11 a passage 16 and a passage 17, and in the arrangement of FIG. 2 these passages 16 and 17 extend diagonally with regard to the plate 11, i.e. terminate at the corners between the narrow sides 12 and 13 of each such plate, whereas in the modified showing of FIG. 3 the passages or passageways 16 and 17 extend parallel to the narrow sides 12 and 13 respectively.

These passages or passageways 16 and 17 serve for the reception of tensioning or tightening elements 18 and 19, respectively, wherein in FIG. 1 only a few have been schematically illustrated, and which tensioning elements, as will be demonstrated more fully hereinafter, serve to interlock or connect the plates 11 to one another in the plane thereof. For this purpose there can be used conventional clamping or tensioning elements 18, which can be, for instance, wire cables or tensioning elements known from the building industry from prestressed concrete or from the field of rock anchors or tie rods. In FIG. 1 the tensioning means for tightening the tensioning or tightening elements 18 and 19 have only been schematically indicated and designated by reference character 20.

Consequently, the tensioning elements 18 and 19 form to a certain extent a pre-stressed netting which establishes the interconnection of the plates 11 with one another, without however having to be secured in each of the plates 11.

The diagonal arrangement of the tensioning elements 18 and 19 with respect to the plates 11, particularly in the case of long ground surfaces which are to be covered, such as streets and runways, provide the advantage that the tensioning elements 18 and 19 can be essentially of the same length. In the case of ground surfaces which are to be covered, where the dimension in one direction is not appreciably greater than the dimension in the other direction, it is of course possible to have the tensioning elements extend also parallel to the sides of the plates 11, as such has been shown for instance for the plate portrayed in FIG. 3.

Continuing, from the showing of FIG. 1 it will be apparent that for exchanging for instance the plate 11' it is adequate to remove, in a manner still to be described, the spacer holder engaging at such plate and to release the tensioning elements 18, 19 which cross in the plate 11' and then to retract such until they depart from the plate 11', whereafter such plate can be pushed out and replaced by another plate, without having to even slightly shift the remaining plates.

Figure 2:
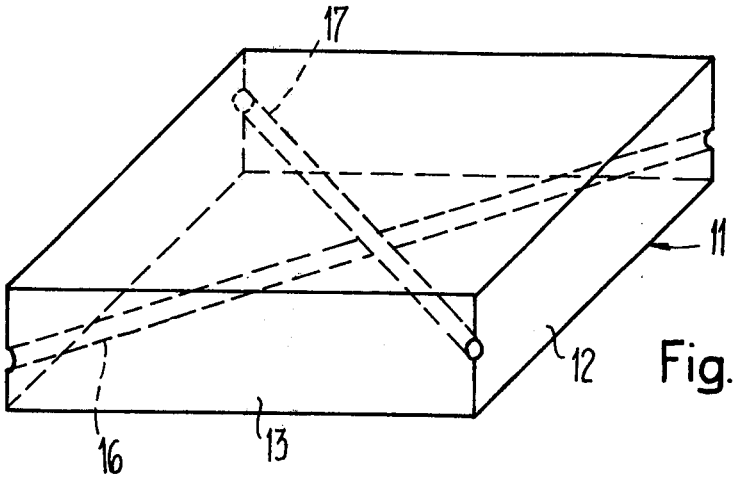
FIG. 2 is a simplified, perspective view, on an enlarged scale in relation to the showing of FIG. 1, of one of the plates of the ground covering of FIG. 1, wherein however the sockets for the reception of the contact surface of the spacer holders have not been shown to simplify the illustration.
Figure 3:
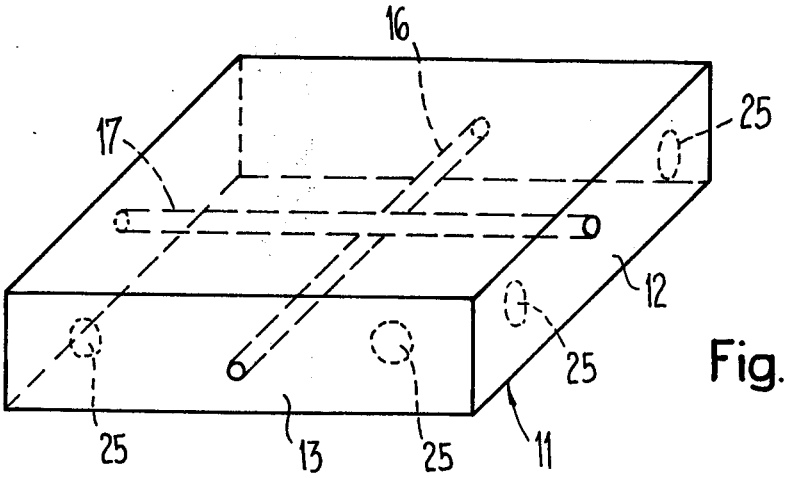
FIG. 3 is a variant embodiment of a plate of the ground covering of the invention and at which there has been shown a possible arrangement of the sockets.
Figure 4:
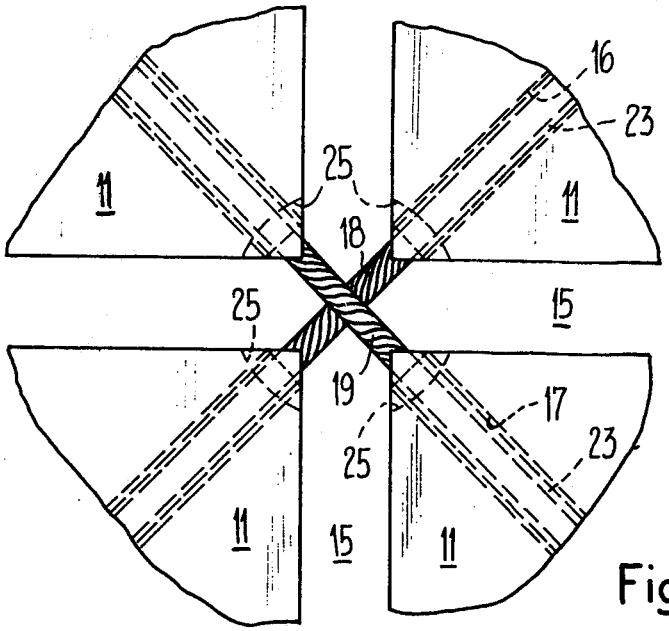
FIG. 4 is a top plan view of the region of the confronting corners of four neighboring plates, prior to insertion of the spacer holders, however with the tensioning or clamping elements already inserted but not yet tightened.
Figure 5:
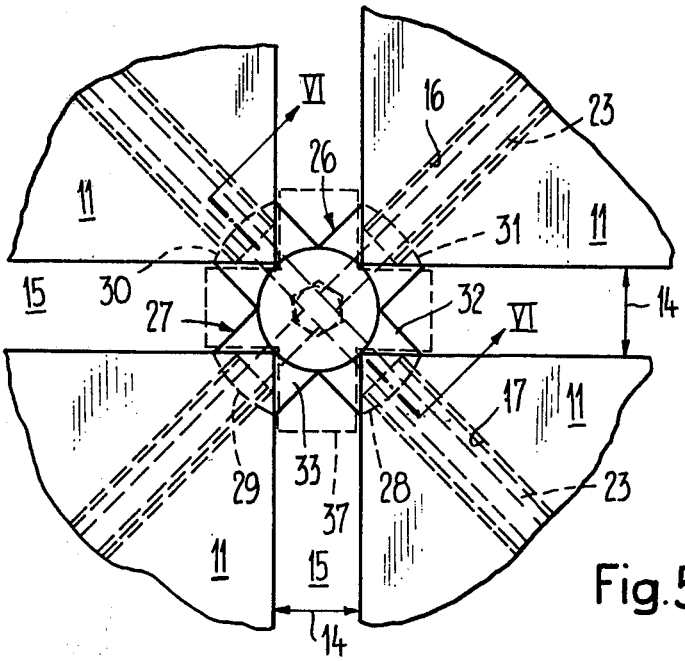
FIG. 5 is a top plan view similar to the showing of FIG. 4, but with the spacer holders inserted.
Figure 6:
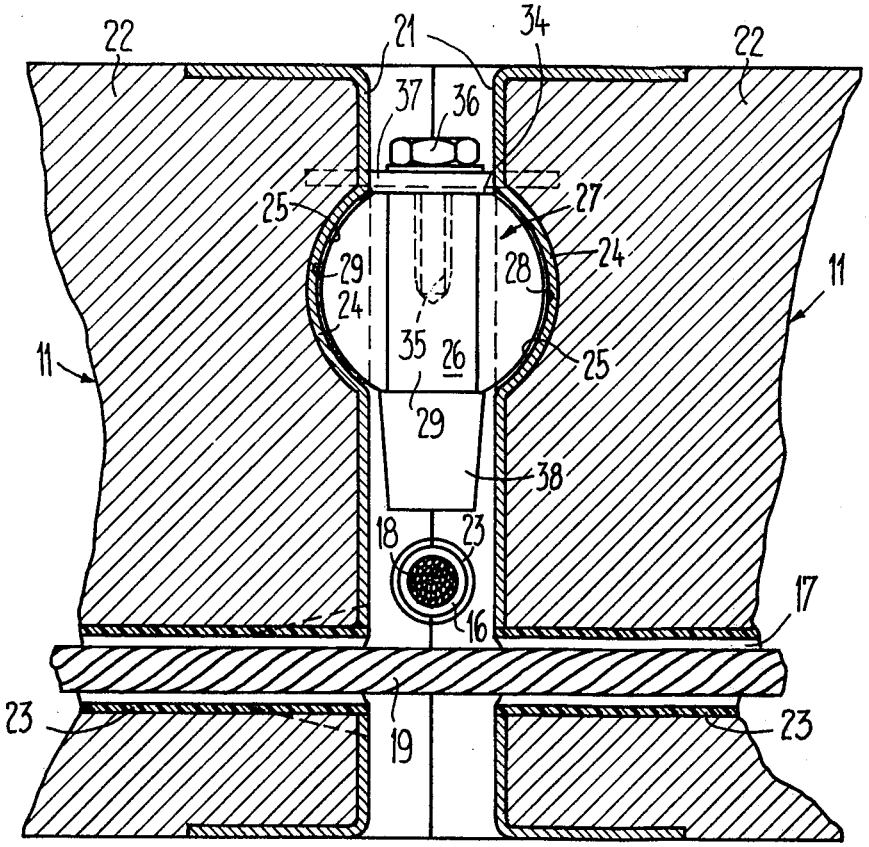
FIG. 6 is a cross-sectional view of FIG. 1 or FIG. 5, taken substantially along the line VI—VI thereof.

Turning attention now to FIGS. 4-6, there will be recognized the location where the one corner of each of the four plates 11 constructed in the manner of the showing of FIG. 2 are located opposite one another, i.e., the location where two drainage channels 15 intersect.

The plates 11 in turn are lined along their entire peripheral edge, but in any event preferably at the region of their corners at the narrow sides by means of a sheet metal profile or structural member 21, as best seen by referring to FIG. 6. Such sheet metal profile members 21 can be introduced into the not particularly illustrated mold during the course of the pre-fabrication of the plates 11 and can be molded with the material or mass 22 of the plates 11—which --which material as a general rule is concrete, but also can have a grid reinforcement.

The passages 16 and 17 are lined, for instance, by plastic pipes 23 in the manner of concealed-installation pipes, which plastic pipes 23 equally can be molded during the fabrication of the plates 11. The ends of the passageways or bores 16 and 17, as best seen by referring to the left-hand side of FIG. 6, can be conically widened, in order to thus facilitate the "threading-in" of the tensioning elements 18 and 19, after the plates 11 have been laid in spaced relationship from one another.

Above the ends of the passages or passageways 16 and 17 there are formed spherical segment-like sockets 25 in the corners of the plates 11, these sockets 25 being defined by depressions or recesses 24 provided at the sheet metal profile or structural elements 21. The radius of curvature of such sockets 25 is preferably selected such that confronting sockets 25 collectively form a sphere or ball, i.e., confronting sockets 25 have a common curvature center which, in turn, is disposed at the longitudinal central plane of a related drainage channel 15.

In any case it is not absolutely necessary that the sockets 25 be arranged vertically above the ends of the passages 16 and 17, and that each end of one of such passages only have one socket. As indicated in FIG. 3, the sockets 25 can be laterally offset with regard to the ends of the passages 16 and 17 at the narrow sides 12, 13. In any event the arrangement of the sockets 25 is carried out such that with the plates 11 laid the sockets of neighboring plates at least come to lie in confronting relationship to one another in pairs. The sockets 25 serve for the reception of the spacer holders which have been generally designated by reference character 26, and which will be more fully described hereinafter with regard to the showing of FIGS. 7 and 8.

The most important part of each spacer holder 26 is a pressure body 27 having a spherical envelope or outer surface, the radius of which approximately corresponds to that of the sockets 25. This pressure body 27 possesses pairs of oppositely situated impact or contact surfaces which face away from one another, and in FIGS. 5–8 there have been for instance illustrated the four contact or impact surfaces 28, 29, 30 and 31. These contact or impact surfaces are spherically arched or domed and have a width b which is less than the width of the drainage joints or channels 15, i.e., than the spacing 14. It is most advantageous if the contact surfaces of a pair, in the embodiment under discussion, for instance, on the one hand, the contact or impact surfaces 28, 30, and on the other hand, the contact or impact surfaces 29, 31 each are constructed as part of the outer or jacket surface of a spherical zone 32, 33, and in the embodiment under consideration the spherical zones are disposed at right angles to one another. As to the sockets 25 of the plates according to the showing of FIG. 3 there are required pressure bodies having only two oppositely situated contact or impact surfaces, since here only two sockets are located opposite one another.

At the region of the upper apex of the pressure body 27 the spacer holder 26 which is preferably formed of one-piece, for instance, of cast iron has a flattened portion 34 and at its center a threaded bore 35. To this flattened portion 34 there is fixedly screwed or otherwise appropriately connected a securing element 37 as soon as the spacer holder 26 has been brought into its engaged position. Such attachment of the arresting or securing element 37 to the flattened portion 34 can be accomplished, for instance, by means of a threaded bolt 36 or other suitable fastening expedient, and such securing element 37 prevents the spacer holder 26 from rotating out of engagement with the sockets 25 about an approximately vertical axis of rotation.

Figure 9:
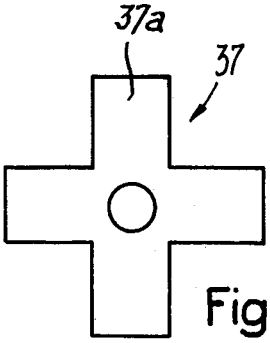
FIG. 9 is a top plan view of a securing element which is detachably connected at the spacer holder in order to secure such against rotation which would place it out of its engaged position.

In the case of the embodiment of FIGS. 4–8 this securing element 37 has the shape of a cross as shown in FIG. 9, and the arms **37*a* of which have approximately the same width as the drainage joints or channels 15. As best seen by referring to FIG. 5 where there has been shown the outline of the securing element 37 in phantom lines, it will be recognized that the arms 37*a* of the cross, in the fixedly threaded condition, are arranged turned through about 45° in relation to the spherical zones 32, 33**.

Additionally the spacer holder 26 has a stop or impact pin 38 which tapers towards its free end **38*a* and which is formed at such spacer holder 26 and following the lower apex of the pressure body 27. This stop pin 38 prevents rotation of the spacer holder 26 about a horizontal axis and along therewith a "rolling-out" from the sockets 25 independent of or in addition to the securing or safety element 37**. This is particularly then of advantage when, during use of the covering, all of the plates thereof no longer are located in a single plane.

From what has been discussed above there will be readily apparent the assembly or mounting of the ground covering. Initially the plates 11 are laid at the spacing 14 from one another upon the ground or floor, which can be a merely planed or smooth natural floor. This can be accomplished with simple gauges or calibers. Thereafter, for instance, the tensioning elements 18 and 19 are so to speak "threaded" into the aligned passages 16, 17, however not yet tensioned or tightened. Then the spacer holders 26 are introduced between neighboring plates 11 at the height of the sockets 25 and turned into the sockets 25, whereafter the securing elements 37 are attached to the spacer holders 26. Then, or already after the screwing in of the spacer holders 26 into the sockets 25, the tensioning elements 18 and 19 are tightened by any suitable tensioning means.

Notwithstanding the tensioning forces which tend to draw the plates 11 towards one another, the spacer holders 26 insure that, first of all, there remains the spacing 14 between the plates 11 and thus the integrity of the drainage channels 15, and secondly, that there is established a positive or form-locking connection which is effective transversely with respect to the plane of the plates, and thirdly, that there is maintained a certain articulation, but however limited degree of freedom of mobility of neighboring plates with respect to one another. The described spacer holders 26 likewise insure a positive connection which is effective in the plane of the plates, so that there is also not possible any displacement or shifting of the plates in their plane.

The exchange of a defective plate 11 of the ground or floor covering 10 is accomplished in the following manner: the tensioning elements which cross at the defective plate are released and such are pulled to such an extent back until they have departed from such defective plate. Then all of the spacer holders which engage at such plate are turned-out of the sockets and removed, whereafter the defective plate can be pushed out and replaced by a new plate. Shifting of the remaining plates 11 is not possible, because, as already mentioned, the remaining still clamped or tightened spacer holders provide a positive or form-locking connection which is effective in the plane of the plates.

Due to the presence of the drainage channels 15 there is afforded, apart from the advantage of avoiding the formation of puddles or water pools, still a further advantage. It has already been mentioned that the described ground covering is especially suitable to be laid upon simply planed natural floors. Exactly in this instance it is impossible to eliminate locally limited ground sagging after laying of the covering. Such ground or floor sagging can be compensated by the described ground covering due to its ability to snugly adhere to the ground owing to the hinge-like mobility of the plates with regard to one another, namely then when the tensioning elements have only been tightened to such an extent that the spacer holders are pressed into the related sockets. If the sinking of the supporting ground or floor exceeds a tolerable maximum, then by further tightening the tensioning elements it is possible to raise the plates which are located above the sunken portion of the ground or such can be at least relieved and the corresponding intermediate space or void can be at least partially filled by floating in filler material, for instance sand, through the drainage channels 15, so that the sunk portion of the ground can be compensated. Of course, this compensation can be accomplished also by temporarily removing the plates above the sunk portion of the ground.

It should be understood that the spacing 14 as a general rule is accomodated to the transportation means for which there has been erected the ground covering. The smaller the wheel diameter or the wheel width, as the case may be, then of course the smaller should be the selection of the spacing 14. When the transportation means are equipped with particularly large wheels or in the case of vehicles equipped with caterpillar tracks the size of the spacing 14 is of lesser significance.

Figure 10:
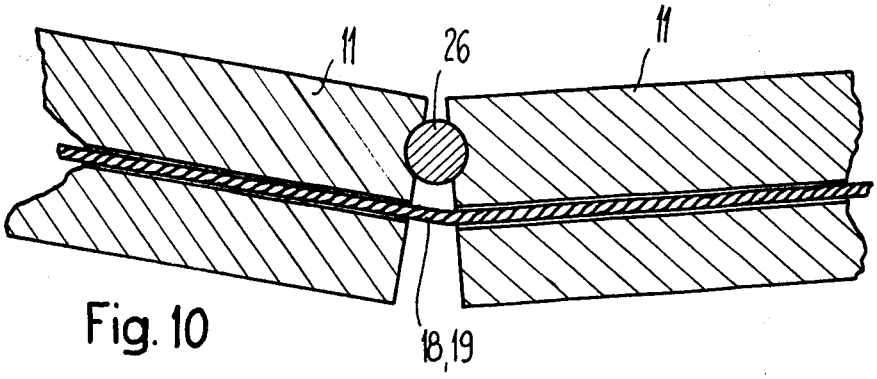
FIGS. 10 and 11 are respective markedly simplified sectional views of two neighboring plates, showing in an exaggerated manner the hinge action of the spacer holder.
Figure 11:
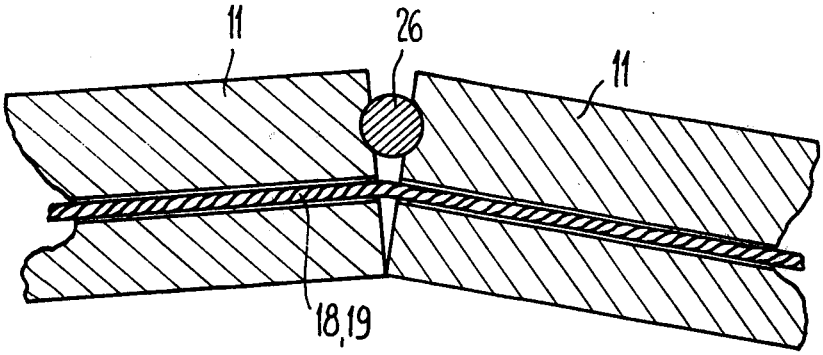

Finally, in the schematic showing of the FIGS. 10 or 11 there has been illustrated in somewhat exaggerated manner the previously mentioned limited articulated mobility of neighboring plates with regard to one another.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A ground covering comprising:
a number of adjoining plates;
tensioning elements for interconnecting the plates with one another;
said tensioning elements extending essentially parallel to the plates and through said plates;
positive locking elements for interconnecting neighboring plates with one another with a spacing therebetween, said positive locking elements being effective between neighboring plates in a direction transverse to a plane containing the plates;
said positive locking elements comprising spacer holders having arched impact surfaces;
each of said plates having narrow sides provided with sockets for receiving said impact surfaces; and
the width of each spacer holder, measured parallel to the plane of the plates, being less than the spacing between the plates;
whereby all spacer holders which engage at such plates may be turned out of the sockets and removed therefrom.

2. A ground covering comprising:
a number of adjoining plates;
tensioning elements for interconnecting the plates with one another;
said tensioning elements extending essentially parallel to the plates and through said plates;
positive locking elements for interconnecting neighboring plates with one another with a spacing therebetween, said positive locking elements being effective between neighboring plates in a direction transverse to a plane containing the plates;
said positive locking elements comprising spacer holders having arched impact surfaces;
each of said plates having narrow sides provided with sockets for receiving said impact surfaces;
the width of each spacer holder, measured parallel to the plane of the plates, being less than the spacing between the plates; and
said plates being four cornered;
the tensioning elements extending diagonally through the plates.

3. The ground covering as defined in claim 1, wherein:
said ground covering is used to cover a planed natural floor.

4. A ground covering comprising:
a number of adjoining plates;
tensioning elements for interconnecting the plates with one another;
said tensioning elements extending essentially parallel to the plates and through said plates;
positive locking elements for interconnecting neighboring plates with one another and effective between neighboring plates in a direction transverse to a plane containing the plates;
said positive locking elements comprising spacer holders having arched impact surfaces;
each of said plates having narrow sides provided with sockets for receiving said impact surfaces;
the impact surfaces of each spacer holder being substantially spherical;
the sockets having the shape of essentially a hollow spherical segment; and
the width of each spacer holder, measured parallel to the plane of the plates, being less than the spacing between the plates;
whereby all spacer holders which engage at such plates may be turned out of the sockets and removed therefrom.

5. The ground covering as defined in claim 4, wherein:
the spherical impact surfaces of the spacer holders constitute jacket surfaces of spherical zones having a common center.

6. The ground covering as defined in claim 5, wherein:
said plates have four corners;
said sockets for the reception of the impact surfaces of the spacer holders being formed at the corners of the plates;
each spacer holder being a one-piece structure in the form of two spherical zones disposed essentially at right angles to one another;
the thickness of the spherical zones being less than the spacing between neighboring plates.

7. A ground covering comprising:
a number of adjoining plates;
tensioning elements for interconnecting the plates with one another;
said tensioning elements extending essentially parallel to the plates and through said plates;
positive locking elements for interconnecting neighboring plates with one another with a spacing therebetween, said positive locking elements being effective between neighboring plates in a direction transverse to a plane containing the plates;
said positive locking elements comprising spacer holders having arched impact surfaces;
each of said plates having narrow sides provided with sockets for receiving said impact surfaces;
the width of each spacer holder, measured parallel to the plane of the plates, being less than the spacing between the plates; and
the spacer holders being arranged between the upper side of the ground covering and the tensioning elements.

8. A ground covering comprising:
a number of adjoining, four cornered plates;
tensioning elements for interconnecting the plates with one another;
said tensioning elements extending essentially parallel to the plates and through said plates;
positive locking elements for interconnecting neighboring plates with one another and effective between neighboring plates in a direction transverse to a plane containing the plates;
said positive locking elements comprising spacer holders having arched impact surfaces;
each of said plates having narrow sides provided with sockets for receiving said impact surfaces;
said sockets for the reception of the impact surfaces of the spacer holders being formed at the corners of the plates; and
the width of each spacer holder, measured parallel to the plane of the plates, being less than the spacing between the plates;
whereby all spacer holders which engage at such plates may be turned out of the sockets and removed therefrom.

9. The ground covering as defined in claim 8, wherein:
said tensioning elements extend diagonally through the plates.

10. A ground covering comprising:
a number of adjoining plates;
tensioning elements for interconnecting the plates with one another;
said tensioning elements extending essentially parallel to the plates and through said plates;
positive locking elements for interconnecting neighboring plates with one another and effective between neighboring plates in a direction transverse to a plane containing the plates;
said positive locking elements comprising spacer holders having arched impact surfaces;
each of said plates having narrow sides provided with sockets for receiving said impact surfaces;
stop means provided at the spacer holders and coacting with the narrow sides of the plates;
said stop means limiting the spacer holders from rotating about axes parallel to the plane of the plates; and
the width of each spacer holder, measured parallel to the plane of the plates, being less than the spacing between the plates;
whereby all spacer holders which engage at such plates may be turned out of the sockets and removed therefrom.

11. A ground covering comprising:
a number of adjoining plates;
tensioning elements for interconnecting the plates with one another;
said tensioning elements extending essentially parallel to the plates and through said plates;
positive locking elements for interconnecting neighboring plates with one another and effective between neighboring plates in a direction transverse to a plane containing the plates;
said positive locking elements comprising spacer holders having arched impact surfaces;
each of said plates having narrow sides provided with sockets for receiving said impact surfaces;
the width of each spacer holder, measured parallel to the plane of the plates, being less than the spacing between the plates;
whereby all spacer holders which engage at such plates may be turned out of the sockets and removed therefrom; and
detachable arresting means provided at the spacer holders for safeguarding rotation of the spacer holders about an axis disposed essentially at right angles to the plane of the plates.

* * * * *